US005546832A

United States Patent [19]

Townsend

[11] Patent Number: 5,546,832

[45] Date of Patent: Aug. 20, 1996

[54] STRIKING APPARATUS HAVING AN INTERCHANGEABLE HEAD

[76] Inventor: Kevin P. Townsend, 535 Chalan Pale R.H., #116-16, Yigo, Guam 96929

[21] Appl. No.: 388,225

[22] Filed: Feb. 10, 1995

[51] Int. Cl.[6] ..... B25D 1/02

[52] U.S. Cl. ..... 81/25; 81/20

[58] Field of Search ..... 81/20, 25, 489; 30/286, 295, 308.1, 308.3

[56] References Cited

U.S. PATENT DOCUMENTS

| | | | |
|---|---|---|---|
| 1,518,259 | 12/1924 | Filiatreault | 81/20 |
| 2,755,833 | 7/1956 | Quayle | 81/25 |
| 2,938,412 | 5/1958 | Walker | 81/15 |
| 3,211,198 | 10/1965 | Glasgow | 145/29 |
| 3,385,334 | 5/1968 | Clay | 145/36 |
| 3,704,734 | 12/1972 | Soto et al. | 145/29 |
| 4,154,273 | 5/1979 | Pollak | 145/29 |
| 4,363,344 | 12/1982 | Pollak | 145/29 |
| 4,548,248 | 10/1985 | Riemann | 81/22 |
| 4,558,726 | 12/1985 | Clay | 81/25 |
| 4,753,137 | 6/1988 | Kennedy | 81/22 |
| 4,850,079 | 7/1989 | Thompson | 16/111 |
| 4,882,956 | 11/1989 | Lang | 81/20 |
| 4,958,540 | 9/1990 | Davis | 81/20 |
| 5,337,836 | 8/1994 | Williams | 173/90 |
| 5,372,053 | 12/1994 | Lee | 81/20 |

*Primary Examiner*—James G. Smith

*Attorney, Agent, or Firm*—Townsend and Townsend and Crew LLP

[57] ABSTRACT

The invention provides a striking apparatus having an interchangeable head. The apparatus includes a handle having a distal end, a proximal end, and an axial lumen extending therebetween. The handle is removably connected to the head at its distal end by a bolt extending through the lumen and into the head. An extension is removably held at the proximal end of the handle. The extension has an aperture for receiving a head of the bolt.

18 Claims, 7 Drawing Sheets

STRIKING APPARATUS HAVING AN INTERCHANGEABLE HEAD

BACKGROUND OF THE INVENTION

1. Field of the Invention

The invention relates generally to a striking apparatus, and in particular, to a striking apparatus having a handle that is interchangeable with a variety of heads. In one particular aspect, the invention provides a handle having an improved grip that also serves as a protector for an operator's fingers. In another aspect, a portion of the handle can conveniently be removed and used as a tool for attaching and removing the head.

Most striking apparatus, such as hammers, have a head with an end for striking articles and a handle that is attached to the head. The head is usually constructed of a hard material, usually metal, and can be used for extended periods of time without significant wear. The handle is usually made of a strong but lightweight material, such as wood, nylon, or fiberglass.

Striking apparatus are used in a variety of applications including construction, woodworking, home repair, automotive body repair, and the like, with each application requiring several different apparatus. For example, an autobody repairman may require the use of a conventional hammer, a ballpean hammer, a hammer having a sharpened end, or a sledge hammer. One problem often experienced when using such a variety of striking apparatus is that each apparatus has a different sized handle. Having a variety of different sized handles can be inconvenient to the operator, particularly if they do not fit the grip of the operator. Providing storage for a large number of different striking apparatus can also be inconvenient. Having such a large assortment of handles is also costly.

One proposed solution to such problems has been to provide a handle that is interchangeable with a variety of heads. However, the proposed apparatus suffer from a number of serious drawbacks. For instance, the handles of some striking apparatus are difficult to interchange with other heads. This can greatly inconvenience the operator who may need to rapidly interchange the heads. Another drawback to some of the proposed apparatus is that they do not provide a stable connection between the head and the handle. For instance, some apparatus have a handle that screws into the head. When striking articles, the head can easily rotate and thereby become disengaged from the handle.

Another problem associated with most striking apparatus is that it is difficult to maintain a firm grip on the handle during use. For instance, a user's hand can slide down the handle while swinging the striking apparatus. If a secure grip is not maintained, the handle can slip from the operator's hand posing a serious threat of injury to the operator or to others. A further problem with most striking apparatus is that the operator's fingers can become smashed when striking articles. This can happen, for instance, if the handle comes too close to another object and is smashed between the object and the handle.

It would therefor be desirable to provide a striking apparatus that could overcome or greatly reduce such problems. In particular, the striking apparatus should have a handle that is interchangeable with a variety of heads. The handle should be easy to change with other heads and should be able to be securely fastened to each of the heads. It would further be desirable to provide a striking apparatus having an improved grip so that the operator's hands do not slide from the handle during use. In another aspect, it would be further desirable to provide a striking apparatus having a protector for protecting the user's fingers when swinging the apparatus. In one particular aspect, it would be desirable to provide all of the above features in a single striking apparatus.

2. Description of the Background Art

U.S. Pat. Nos. 1,097,521; 2,489,841; 2,938,412; 3,211,198; 3,704,734; 3,385,334; 4,753,137; and 5,337,836 describe striking apparatus having interchangeable heads.

U.S. Pat. Nos. 345,639; 4,154,273; 4,363,344; 4,548,248; 4,850,079; 4,882,956; 4,958,540; and Des. 35,446 describe handles for striking apparatus having various grips.

SUMMARY OF THE INVENTION

The invention provides a striking apparatus having a handle that is interchangeable with a variety of heads. The handle has a distal end, a proximal end, and an axial lumen extending therebetween. The handle is removably connected to the head at its distal end by a bolt that extends through the lumen and into the head. In this way, the handle and the head can be connected by torquing the bolt at the proximal end of the handle. As the bolt is torqued, a proximal end of the bolt engages the proximal end of the handle to secure the handle to the head. Combining the handle and head in this manner is convenient to a user who is only required to torque the bolt to combine or separate the handle and head. The apparatus further includes an extension removably held at the proximal end of the handle. The extension has an aperture for receiving a head of the bolt. In one particular aspect, the extension serves as a protector for the operator's fingers.

In an exemplary aspect, means are provided at the distal end of the handle for preventing rotation of the bolt relative to the head. In this way, the head remains securely fashioned to the handle even when the head is struck against an article. Conveniently, the means for preventing rotation is the extension. The extension prevents rotation of the bolt when the aperture of the extension is received over the bolt head and the extension is securely fastened to the handle. In a preferable aspect, a snap is provided for securing the extension to the handle.

In another exemplary aspect, the handle includes a protrusion at its proximal end for preventing a hand from slipping proximally down the handle. The protrusion is generally orthogonal to the handle and extends from the handle in the direction of a striking surface on an end of the head. In this way, a user can rest his fingers on the protrusion when operating the striking apparatus. The protrusion engages the fingers and prevents them from slipping proximally down the handle.

In one particular aspect, the extension has a first portion and a second portion, with the first and second portions being orthogonal to each other. In a further aspect, the first portion of the extension is adjacent to and aligned with the protrusion and includes the aperture, and the second portion is generally parallel to the handle. In still a further aspect, the second portion of the extension extends in a direction toward the head, and the aperture is received over the head of the bolt to define a protecting position. In the protecting position, the second portion of the extension serves as a protector to help prevent the operator's fingers from becoming smashed by the handle when operating the striking apparatus. At the same time, the extension prevents rotation of the bolt since the bolt head is received in the aperture.

In still a further aspect, the second portion of the extension extends in a direction away from the head, and the aperture is received over the head of the bolt to define a torquing position. In the torquing position, the handle serves as a lever arm which can be grasped and rotated to torque the bolt. In this way, the extension can conveniently be used as a tool for attaching or removing the handle from the head. After use as a tool, the extension can be reattached to the handle in the protecting position to serve as a protector and to secure the handle to the head by preventing rotation of the bolt.

In yet another aspect, a second protrusion is provided on the handle. The second protrusion is generally parallel to the protrusion at the proximal end of the handle. The second protrusion is removably connected to the second portion of the extension. In this way, a closed loop is formed at the proximal end of the handle for receiving and protecting a hand of the user. Preferably, the first portion will have a length in the range from about 3 cm to 10 cm, and the second portion will have a length in the range from about 1 cm to 25 cm.

In still another aspect, the proximal end of the handle defines a gripping portion having a plurality of grooves for receiving the fingers of a hand. Preferably, a rubber coating is provided on the gripping portion of the handle. In another aspect, the handle is constructed of nylon.

In another embodiment of the invention, a striking apparatus is provided having an interchangeable head with a body having a striking end. The body defines a central aperture for receiving a handle and a threaded cylindrical aperture for receiving a shaft. An elongate handle having a proximal and a distal end is provided, with the proximal end being removably received in the central aperture of the head. The handle has a central lumen extending between the proximal and distal ends and is aligned with the threaded aperture of the head. An elongate shaft having a proximal end and a threaded distal end extends through the lumen with the threaded distal end being received in the threaded aperture of the head. The proximal end of the shaft engages the handle to hold the head and the handle together. Means are provided at the proximal end of the handle for preventing rotation of the shaft relative to the head when the distal end of the shaft is received in the threaded aperture and the proximal end of the shaft engages the handle.

In a preferable aspect, the proximal end of the handle and the central aperture of the head are non-circular in geometry. In this way, rotation of the handle relative to the head is prevented when the shaft is received in the threaded aperture of the head and tightened. Such a configuration is advantageous in allowing the head and handle to be secured together by merely rotating the shaft.

In another aspect, the means for preventing rotation includes an extension having an aperture for receiving the proximal end of the shaft. The extension is removably attached to the proximal end of the handle with the aperture being received over the proximal end of the shaft. In a further aspect, means are provided for tightening the shaft against the handle. Preferably, the means for tightening the shaft is the extension.

DETAILED DESCRIPTION OF THE SPECIFIC EMBODIMENTS

Figure 1:
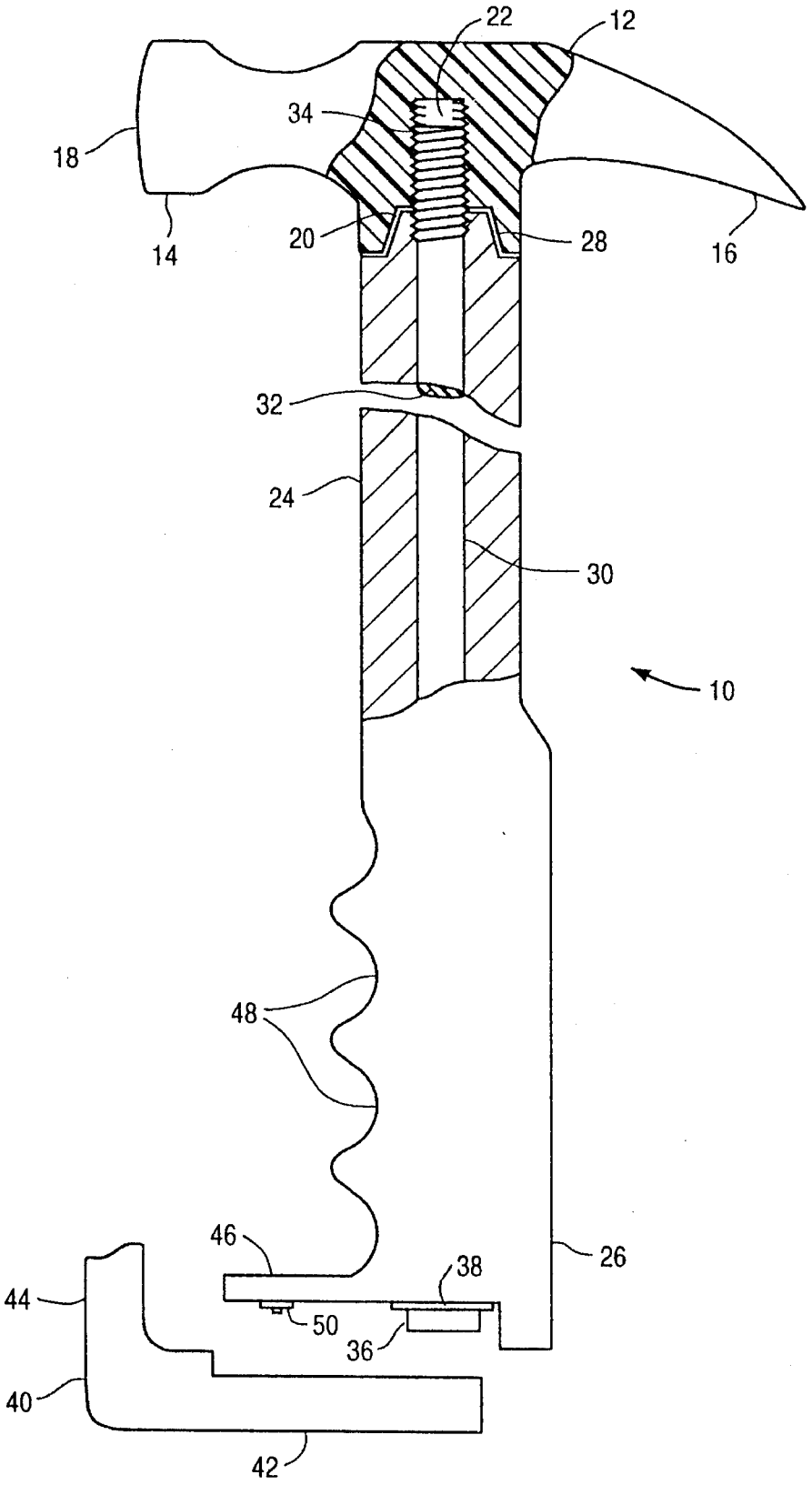
FIG. 1 illustrates a side view of an exemplary striking apparatus having a head, a handle, and an extension according to the prevent invention.

Referring to FIG. 1, an exemplary striking apparatus 10 will be described. The apparatus includes an interchangeable head 12. As used herein, the term "interchangeable" means that a variety of heads can interchangeably be used with a single handle. For illustration purposes, the head 12 is shown as a conventional hammer head. However, the head 12 can be any one of a variety of heads including sledge hammer heads, ballpean hammer heads, pointed hammer heads, axe heads, heads for camping tools, autobody work tool heads, nail hammer heads, and the like. Further alternative heads are described hereinafter with reference to FIGS. 8–10.

The head 12 includes two opposing ends 14, 16, with end 14 having a striking surface 18. The head 12 includes a central aperture 20 and a threaded cylindrical aperture 22. A handle 24 is provided having a proximal end 26 and a distal end 28, with the distal end 28 being received in the central aperture 20. The distal end 28 and the central aperture 20 will preferably have geometries such that the handle 24 and the head 12 are non-rotatable relative to each other when attached. Usually, the geometry of the distal end 28 and central aperture 20 will be non-cylindrical to prevent rotation of the handle 24 relative to the head 12. More preferably, the distal end 28 and central aperture 20 will be tapered and will each be orthogonal in geometry. In this way, the orthogonal surfaces of distal end 28 will engage the orthogonal surfaces of central aperture 20 to prevent rotation relative to each other in a manner similar to placing a square peg in a square hole.

An axial lumen 30 is provided in the handle 24 and extends between the proximal end 26 and distal end 28. The lumen 30 and cylindrical aperture 22 are aligned with each other when the handle 24 is received into the central aperture 20 of the head 12. Extending through the lumen 30 is an elongate shaft 32, preferably a bolt. The shaft 32 has a threaded distal end 34 that can be screwed into the cylindrical aperture 22 by rotating the shaft 32. The shaft 32 includes a head 36 at its proximal end. The periphery of the head 36 is larger than the periphery of the lumen 30 so that the head 36 engages the handle 24 when screwed into the head 12. Optionally, a washer 38 can be provided between the head 36 and the handle 24. With such a configuration, the handle 24 can easily be attached to the head 12 by sliding the distal end 28 of the handle 24 into the central aperture 12. The shaft 32 is then slid through the lumen 30 until the threaded distal end 34 reaches the cylindrical aperture 22. At this point, the shaft 32 is rotated to screw the threaded distal end 34 into the cylindrical aperture 22. The shaft 32 is rotated until the head 36 engages the proximal end 26 of the handle 24 and secures the head 12 to the handle 24. Rotation of the head 12 relative to the handle 24 is prevented while rotating the shaft 32 into the head 12 by the non-cylindrical geometry of the distal end 28 of the handle 24 and the central aperture 20 of the head 12. Once the handle 24 and head 12 are attached, more torque can be applied to the head 36 to tighten the connection between the head 12 and the handle 24.

The handle 24 is constructed so that it can be used with a variety of heads. Each head will be provided with the central aperture 20 and cylindrical aperture 22 so that the handle 24 can be attached as previously described. The handle 24 can easily be interchanged with another head 12 by merely unscrewing the shaft 32 from the head 12, separating the head 12 from the handle 24, placing another head 12 on the handle 24, and screwing the shaft 32 into the head 12. The handle 24 can be constructed from a variety of strong, lightweight materials, such as wood, fiberglass or other composites, and will preferably be constructed of nylon. The shaft 32 will preferably be constructed of metal to provide additional strength to the handle 24 and to provide a solid connection between the handle 24 and head 12.

To further ensure a secure connection between the head 12 and the handle 24, an extension 40 is provided. In one particular aspect, the extension 40 serves to prevent rotation of the shaft 32 once the head 12 and handle 24 have been attached. As described in greater detail hereinafter, the extension 40 in another aspect serves to protect an operator's fingers from injury when operating the apparatus 10. The extension 40 includes a first portion 42 and a second portion 44. The second portion 44 can be fashioned into a variety of geometries as described in greater detail hereinafter. Preferably, the first portion 42 will have a length in the range from about 3 cm to 10 cm, and the second portion will have a length in the range from about 1 cm to 25 cm.

A protrusion 46 is provided at the distal end 26 of the handle 24 and extends orthogonally from the handle 24 in the direction of the end 14 having the striking surface 18. The protrusion 46 is provided in one aspect to prevent an operator's hand from slipping proximately downward from the handle 24 during operation of the apparatus 10. The protrusion 46 engages the operator's end finger to prevent slippage of the operator's hand from the proximal end 26 of the handle 24. Optionally, the handle 24 can be provided with a plurality of grooves 48 for receiving the operator's fingers. The grooves 48 are provided to enhance the operator's grip of the handle 24 when operating the apparatus 10. Optionally, the proximal end 26 of the handle 24 can be coated with a non-slick surface, such as rubber, to further prevent slippage of the handle 24 in the operator's hand.

The extension 40 can be removably attached to the handle 24 by a variety of fastening mechanisms such as clips, clamps, pressure fitting, and the like. Preferably, a snap 50 is provided on the protrusion 46 so that the extension 40 can be securely attached to the handle 24. The mating half of the snap 50 is on the extension 40.

Figure 2:
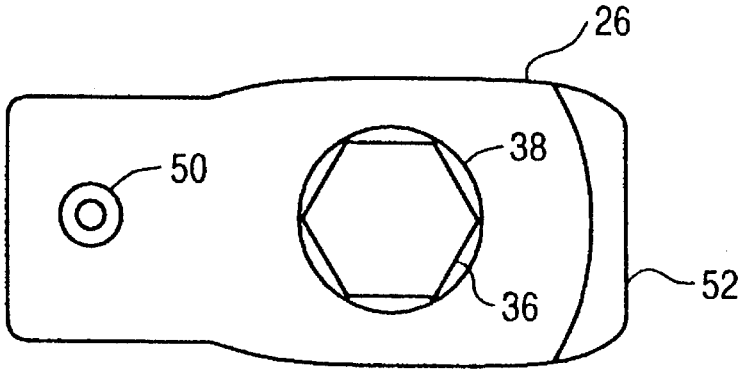
FIG. 2 illustrates a bottom view of the handle of FIG. 1.
Figure 3:
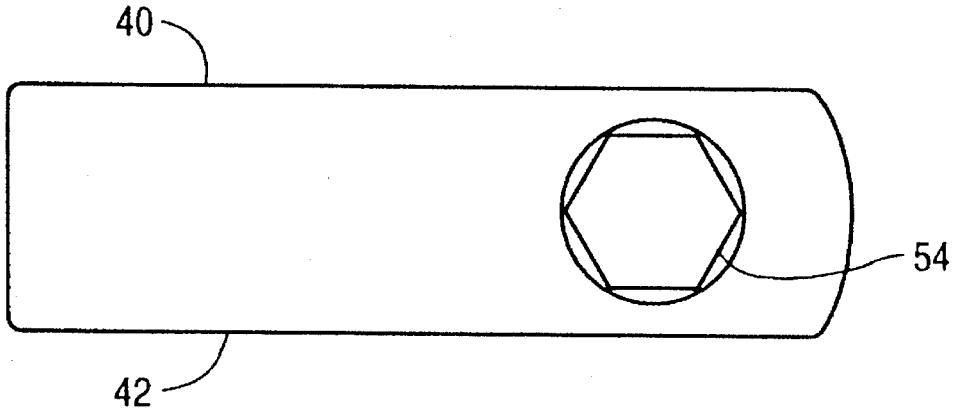
FIG. 3 illustrates a bottom view of the extension of FIG. 1.

Referring to FIGS. 2 and 3, use of the extension 40 to prevent the shaft 32 from unscrewing from the head 12 will be described in greater detail. FIG. 2 shows a bottom view of the proximal end 26 of the handle 24, and FIG. 3 shows a bottom view of the extension 40. A lip 52 is conveniently provided at the proximal end 26 and mates with the first portion 42 of the extension 40 when the extension 40 is snapped to the handle 24. The first portion 42 includes an aperture 54 for receiving and mating with the head 36 of the shaft 32 when the extension 40 is snapped to the handle 24. When the extension 40 is snapped to the handle 24, the first portion 42 is secured over the head 36 and prevents rotation of the head 36. In this way, the shaft 32 is prevented from becoming unscrewed from the head 12 and ensures that the head 12 will remain securely fastened to the handle 24. As previously described, an additional feature of the invention is that the second portion 44 of the extension 40 serves as a protector to protect the operator's fingers when the extension 40 is snapped to the handle 24. In this way, the extension 40 is in a protecting position and serves as both a protector and as a lock for preventing rotation of the shaft 32.

Figure 4:
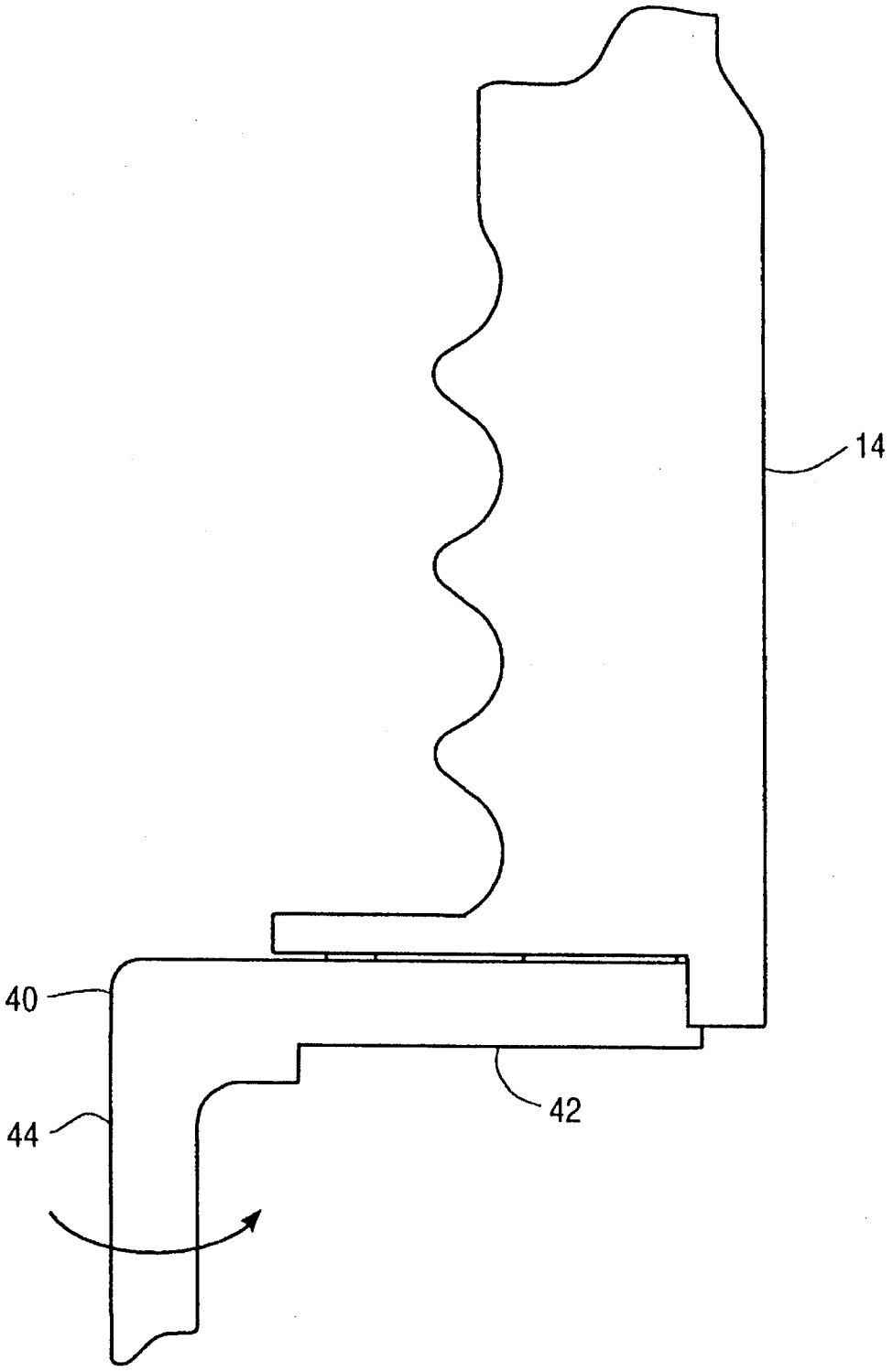
FIG. 4 illustrates a proximal portion of the handle of FIG. 1 with the extension being used as a torquing tool according to the present invention.

As shown in FIG. 4, the extension 40 can optionally be unsnapped from the handle 24 and used as a torquing tool to tighten or loosen the shaft 32. In such a manner, the first portion 42 is received over the shaft head 36, and the second portion 44 is used as a handle which can be grasped and rotated to rotate the shaft 32. In this way, the extension 40 is in a torquing position. After use as a torquing tool, the extension 40 can be removed from the shaft head 36 and snapped to the handle 24 where it prevents rotation of the shaft 32 and simultaneously serves as a finger protector as previously described.

Figure 5:
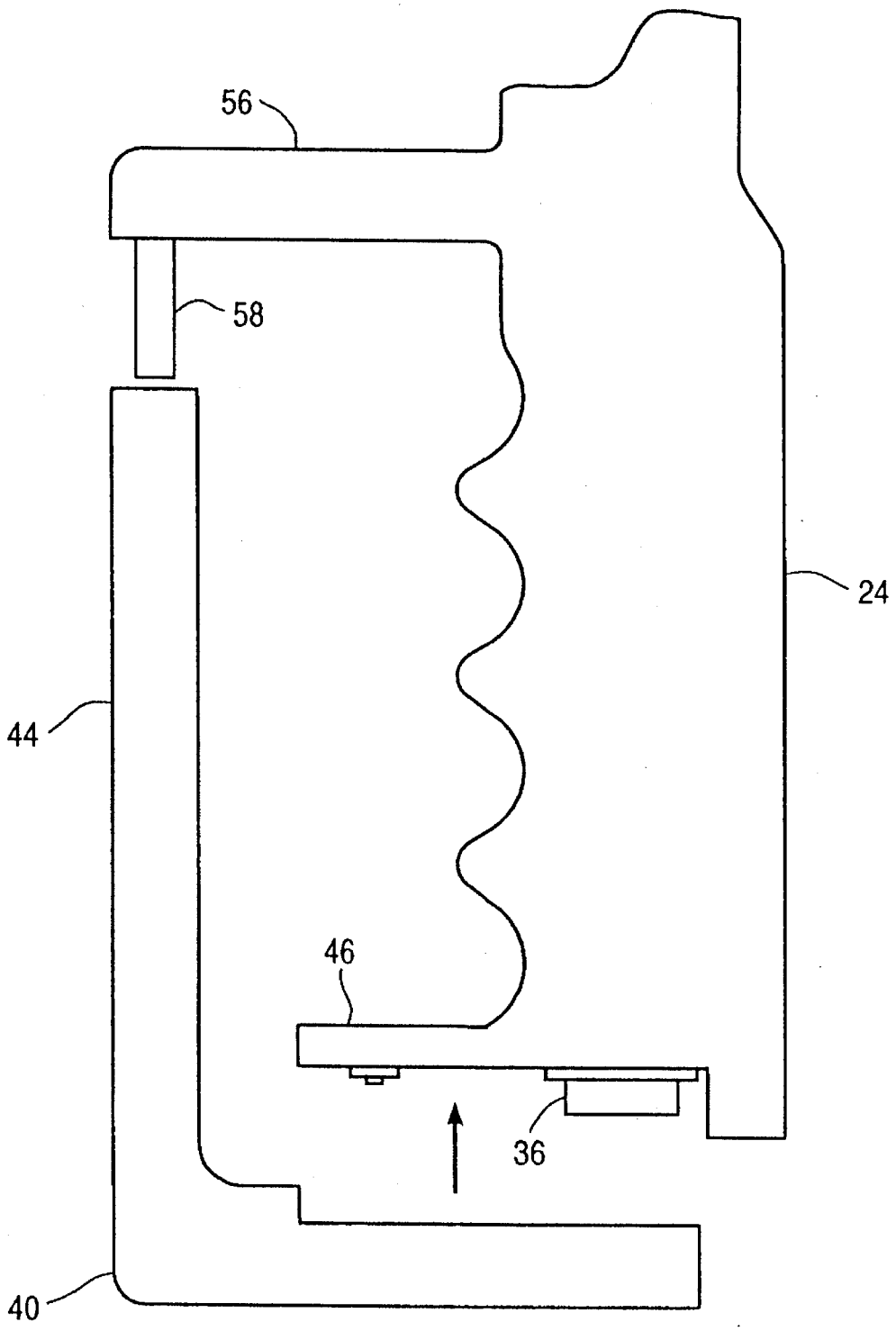
FIG. 5 illustrates an alternative embodiment of the striking apparatus of FIG. 1 wherein the extension is used to form a protective loop at the proximal end of the handle.

An alternative embodiment of the extension 40 is shown in FIG. 5. In this embodiment, the extension 40 is used to provide a closed loop at the proximal end of the handle 24. The closed loop configuration provides increased protection to the operator's fingers and provides for an improved grip. In this embodiment, the second portion 44 is extended and is made sufficiently long to engage a second protrusion 56. The second protrusion 56 is spaced-apart and parallel to the first protrusion 46. In this way, the closed loop is formed when the extension 40 is snapped to the handle 24. A pin 58 is provided on the second protrusion 56 and is received within a slot (not shown) in the second portion 44 to form an engaging connection between the extension 40 and the second protrusion 56 when the extension 40 is snapped to the handle 24. The extension 40 can be removed from the handle 24 and used as a torquing tool as previously described.

Figure 6:
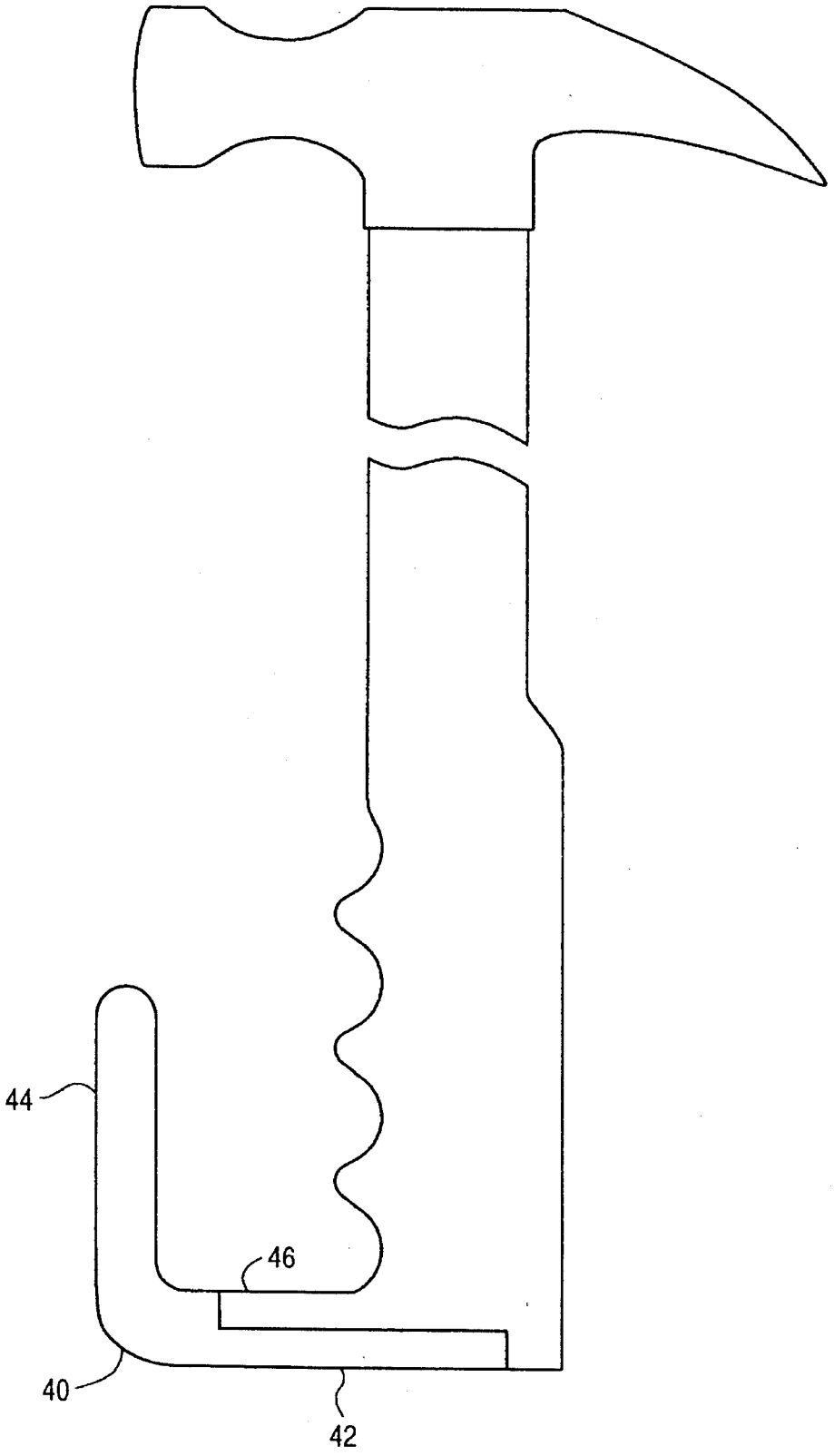
FIG. 6 illustrates another alternative embodiment of the extension of the striking apparatus of FIG. 1.
Figure 7:
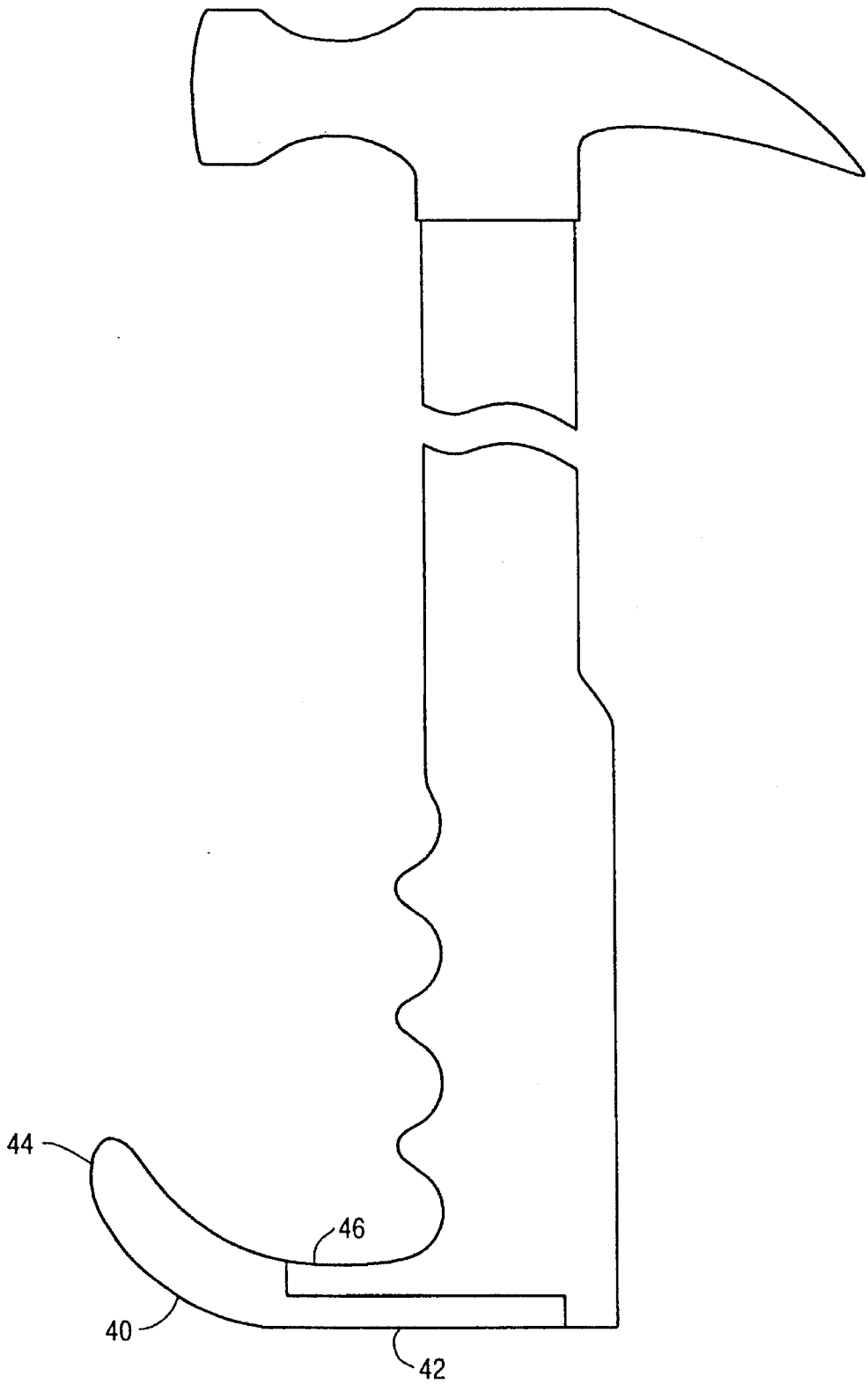
FIG. 7 illustrates yet a further alternative embodiment of the extension of the striking apparatus of FIG. 1.

Two other alternative extension embodiments are shown in FIGS. 6 and 7. In FIG. 6, the second portion 44 of the extension 40 extends distally from the protrusion 46 toward the end 14 of the head 12 but does not form a closed loop. The second portion 44 can be extended to any one of a number of different lengths and will preferably have a length in the range from about 2 cm to 25 cm. In the embodiment in FIG. 7, the second portion 44 extends at an angle from the first protrusion 46. Preferably, the angle between the first portion 42 and the second portion 44 will be in the range from about 0° to 90°.

Figure 8:
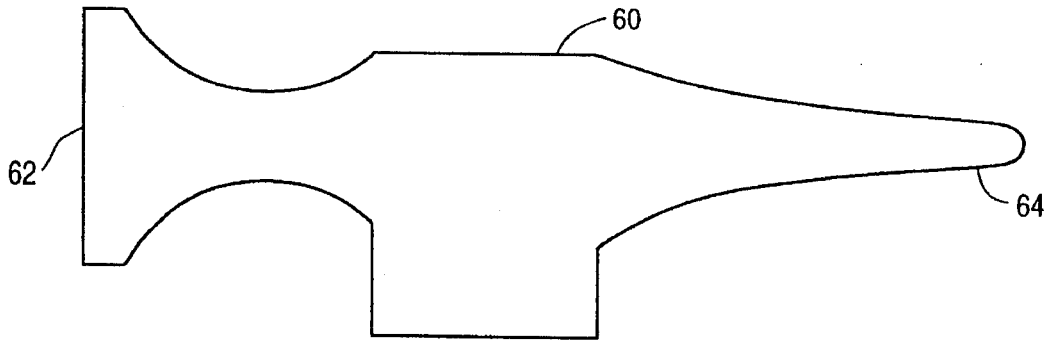
FIGS. 8–10 illustrate alternative heads that can be used with the handle of FIG. 1.
Figure 9:
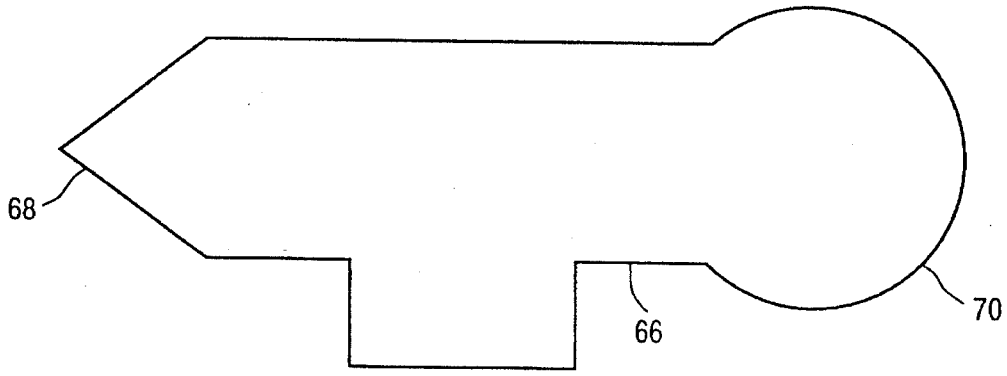
Figure 10:
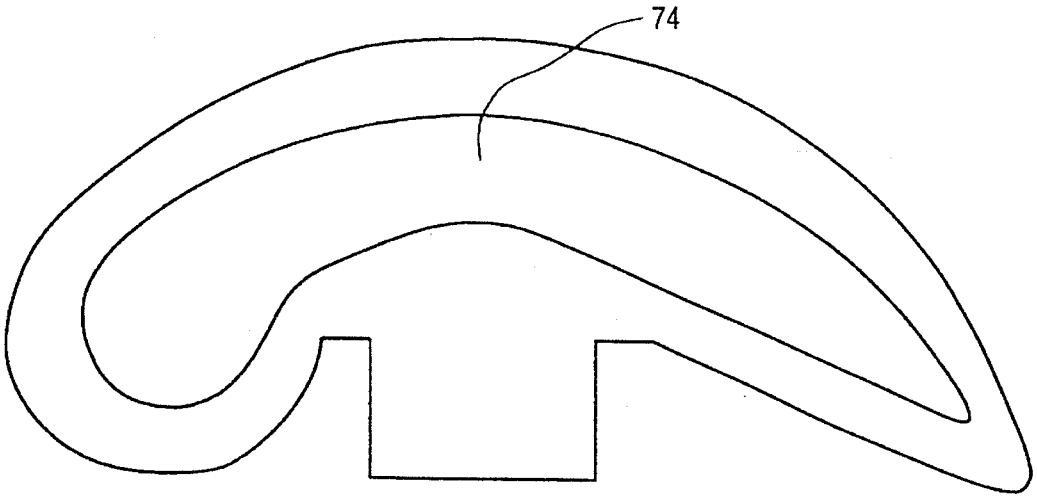

The handle 24 can be provided with a variety of interchangeable heads. FIGS. 8–10 show three exemplary interchangeable heads. A dimple head 60 is shown in FIG. 8. The head 60 has a flat striking surface 62 and a pointed end 64 opposite the striking surface 62. The head 60 is preferably used in autobody work to dimple high spots in metal surfaces.

A shaper head 66 is shown in FIG. 9. The head 66 has a pointed end 68 and a spherical end 70. The head 66 is preferably used in autobody work for working autobody panels.

A dolly head 72 is shown in FIG. 10. The head 72 includes a recessed portion 74. The head 72 is preferably used for autobody work.

Although the foregoing invention has been described in some detail by way of illustration and example, for purposes of clarity of understanding, it will be obvious that certain changes and modifications may be practiced within the scope of the appended claims.

What is claimed is:

1. A striking apparatus, comprising:

an interchangeable head;

a handle having a distal end, a proximal end, and an axial lumen extending therebetween, wherein the handle is removably connected to the head at its distal end by a bolt extending through the lumen and into the head; and an extension removably held at the proximal end of the handle, the extension having an aperture for receiving a head of the bolt.

2. The apparatus of claim 1, wherein the aperture has a geometry which mates with the bolt head to prevent rotation of the bolt relative to the interchangeable head.

3. The apparatus of claim 1, further comprising a snap for securing the extension to the handle.

4. The apparatus of claim 1, wherein the handle includes a protrusion at its proximal end for preventing a hand from slipping proximally down the handle.

5. The apparatus of claim 4, wherein the head has opposing ends, with one of the ends having a striking surface, and wherein the protrusion is generally orthogonal to the primary axis and extends from the handle in the direction of the striking surface.

6. The apparatus of claim 5, wherein the extension has a first portion and a second portion, and wherein the first and second portions are orthogonal to each other.

7. The apparatus of claim 6, wherein the first portion of the extension is adjacent to and aligned with the protrusion and includes the aperture, and wherein the second portion is generally parallel to the handle.

8. The apparatus of claim 7, wherein the second portion of the extension extends in a direction toward the head, and wherein the aperture is received over the head of the bolt to define a protecting position.

9. The apparatus of claim 7, wherein the second portion of the extension extends in a direction away from the head, and wherein the aperture is received over the head of the bolt to define a torquing position, whereby the bolt can be torqued by grasping and rotating the extension.

10. The apparatus of claim 7, further comprising a second protrusion on that handle, the second protrusion being generally parallel to the protrusion at the proximal end of the handle, and wherein the second protrusion is removably connected to the second portion, thereby forming a closed loop at the proximal end of the handle for protecting a hand of a user.

11. The apparatus of claim 10, wherein the first portion has a length in the range from about 3 cm to 10 cm, and wherein the second portion has a length in the range from about 1 cm to 25 cm.

12. The apparatus of claim 1, wherein the proximal end of the handle defines a gripping portion having a plurality of grooves for receiving the fingers of a hand.

13. The apparatus of claim 1, further comprising a rubber coating on a gripping portion of the handle, and wherein the handle is constructed of nylon.

14. A striking apparatus, comprising:

an interchangeable head having a body with a striking end, wherein the body defines a central aperture for receiving a handle, and wherein the body further defines a threaded cylindrical aperture;

an elongate handle having a proximal end and a distal end, the proximal end being removably received in the central aperture of the head, the handle having a central lumen extending between the proximal and distal ends, the lumen being aligned with the threaded aperture of the head;

an elongate shaft extending through the lumen, the shaft having a proximal end and a threaded distal end, the threaded distal end being received in the threaded aperture of the interchangeable head, and the proximal end engaging the handle to hold the head and the handle together; and means at the proximal end of the handle for preventing rotation of the shaft relative to the head when the distal end of the shaft is received in the threaded aperture and the proximal end of the shaft engages the handle, wherein the means for preventing rotation includes an extension having an aperture for receiving the proximal end of the shaft, and wherein the extension is removably attached to the proximal end of the handle with the aperture over the proximal end of the shaft.

15. The apparatus of claim 14, further comprising means for tightening the shaft against the handle.

16. The apparatus of claim 15, wherein the means for tightening the shaft comprises the extension.

17. The apparatus of claim 14, wherein the proximal end of the handle and the central aperture of the head are non-circular in geometry, wherein rotation of the handle relative to the head is prevented when the shaft is received in the threaded aperture of the head and tightened.

18. The apparatus of claim 14, wherein the shaft is constructed of metal.

* * * * *